United States Patent [19]

David

[11] Patent Number: 4,696,775

[45] Date of Patent: Sep. 29, 1987

[54] DEVICE FOR PRODUCING A GAS-AND-LIQUID MIXTURE

[75] Inventor: Peggy F. M. David, De Bilt, Netherlands

[73] Assignee: Kartell SpA, Italy

[21] Appl. No.: 891,615

[22] Filed: Aug. 1, 1986

[30] Foreign Application Priority Data

Sep. 2, 1985 [NL] Netherlands ..... 8502391

[51] Int. Cl.[4] ..... B01F 3/04

[52] U.S. Cl. ..... 261/1; 220/90.4

[58] Field of Search ..... 261/1; 210/464, 469; 220/90.4, 90.2, 90.6, 366

[56] References Cited

U.S. PATENT DOCUMENTS

| | | | |
|---|---|---|---|
| D. 247,541 | 3/1978 | Barger | 220/90.4 |
| 402,620 | 5/1889 | Schue | 210/464 |
| 1,340,886 | 5/1920 | Galleguillos | 220/90.4 |
| 2,265,403 | 12/1941 | Smith | 210/469 |
| 2,693,685 | 11/1954 | Stafford | 220/90.6 |
| 2,861,716 | 11/1958 | Kramer | 220/90.4 |
| 3,184,126 | 5/1965 | Sasull | 220/90.2 |
| 3,185,341 | 5/1965 | Barbour | 220/90.2 |
| 3,587,576 | 6/1971 | Reikes et al. | |
| 3,749,312 | 7/1973 | Panzer | |
| 3,938,695 | 2/1976 | Ruff | 220/90.4 |
| 4,074,709 | 2/1978 | Kaplan | |
| 4,135,512 | 1/1979 | Godsey | |
| 4,184,604 | 1/1980 | Am | 220/90.4 |

FOREIGN PATENT DOCUMENTS

| | | |
|---|---|---|
| 1366310 | 9/1974 | United Kingdom |
| 2146880 | 3/1973 | France |

*Primary Examiner*—Tim Miles

*Attorney, Agent, or Firm*—Parkhurst & Oliff

[57] ABSTRACT

A device for producing a gas-and-liquid mixture, such as for intake by humans, includes a holder for the liquid and a feeding arrangement for the gas. The feeding arrangement includes an element adapted to cooperate with a user's upper lip to comprise a feed valve, which in part blocks the free discharge opening of the holder and can serve at the same time as a supporting surface for the upper lip, and a supporting surface for the lower lip at the same time constituting the feeding arrangement for the gas.

19 Claims, 14 Drawing Figures

DEVICE FOR PRODUCING A GAS-AND-LIQUID MIXTURE

BACKGROUND AND SUMMARY OF THE INVENTION

The invention relates to a device for producing a gas-and-liquid mixture, such as for intake by humans, comprising a supply member for the liquid and a feeding arrangement for the gas. In certain cases of a liquid being taken in by humans there is an advantage of a certain amount of gas being admixed to the quantity of liquid taken.

It is thus known from *Double Contrast Gastrointestinal Radiology,* by Igor Laufer, M.D., published in Philadelphia, U.S.A., and especially from Chapter 4, page 79, therein, that for the purpose of an X-ray examination of the upper digestive tract of humans, the patient must first take an effervescent agent, and thereupon a quantity of contrast liquid. The coming together of the effervescent agent and the contrast liquid then results in the formation of a gas-and-liquid mixture which causes a double-contrast effect to appear, thus rendering more details better visible in the roentgenograms or, in case of direct observation, on luminous screens, than would be the case if use were made of a contrast medium only. This method entails a number of drawbacks. For example, an effervescent agent must be taken first, followed very rapidly thereafter by the intake of the contrast medium, it thereupon being necessary to administer yet another agent for preventing bubbles of an undesirable size from forming in the gas-and-liquid mixture. The desired gas-and-liquid mixture furthermore only has a limited useful life, since the gas vanishes from the mixture, without any possibility of new gas being formed after the effervescent agent has been used up. There is, moreover, no convenient method of restoring the desired gas-to-liquid ratio in the mixture by means of a repeated intake of a quantity of effervescent agent. Nonactivated effervescing particles can give rise to an erroneous interpretation of the X-ray picture obtained.

Further drawbacks consist in the difficulty of apportioning the established dose of liquid, and in the trial-and-error method of establishing the proper quantities of the aforementioned components for attaining an optimum double-contrast effect. Besides, this method is often difficult to use for certain patients, including a number of elderly persons, and not at all for young children. The invention aims at providing a device allowing an even more effective gas-and-liquid mixture to form in a simpler manner upon the intake of the liquid, without any effervescing or other agents being required. This aim is attained according to the invention by providing the device with a supporting surface for the upper lip and a supporting surface for the lower lip, in such a way that gas and liquid and being simultaneously supplied during the intake. Advantages of the device according to the invention are that effervescing or other agents are no longer needed, that the mixture produced has a relatively long useful life, and that the mixture can be replenished at any time. The use of the device also allows such groups as elderly persons and young children to be examined, since the intake fundamentally leaves intact the normal course of the drinking process.

The absence of the need for taking any other agents also obviates the possible presence of such artifacts as undissolved particles which might stand in the way of a correct interpretation of the data obtained. It is a very special advantage that the entire esophagus can now be viewed in double contrast.

Finally, it should be observed that, with the use of the device according to the invention, no overpressure is required, unlike the practice of the siphon method which is occasionally used and by which a gas-and-liquid mixture under excess pressure is forced through a swallowed tube directly into the esophagus (*Double Contrast Gastrointestinal Radiology,* by Igor Laufer, M.D., Chapter 4, page 80). Such a use of overpressure interferes with the normal ingestive process, which can sometimes be unacceptable, such as in the case of elderly persons and young children. Moreover, there is a risk of the esophagus being perforated.

BRIEF DESCRIPTION OF THE DRAWINGS

The invention will now be further explained with the aid of an example of a preferred embodiment wherein.

DETAILED DESCRIPTION OF THE PREFERRED EMBODIMENTS

Figure 1:
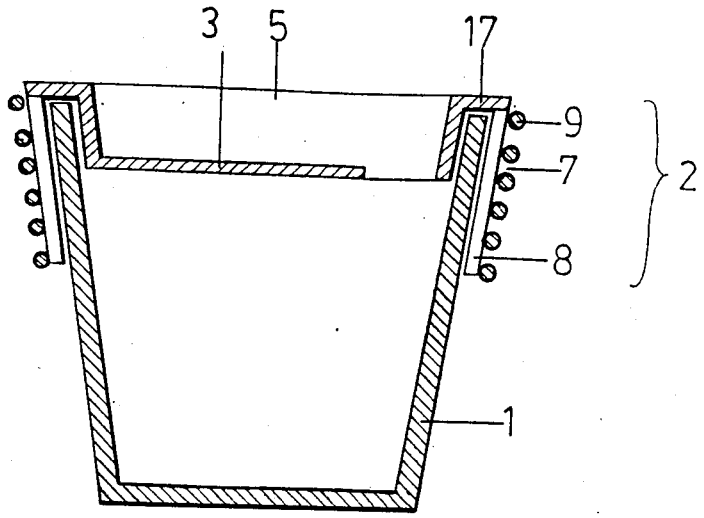
FIG. 1 is a cross-sectional view of an embodiment according to the invention.
Figure 2:
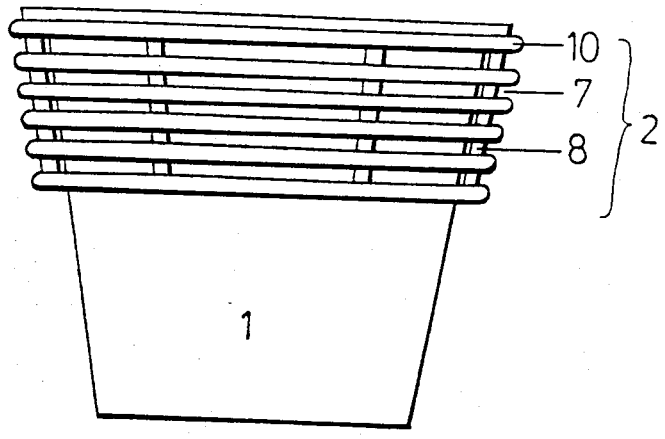
FIG. 2 is a lateral view of the embodiment of FIG. 1.
Figure 3:
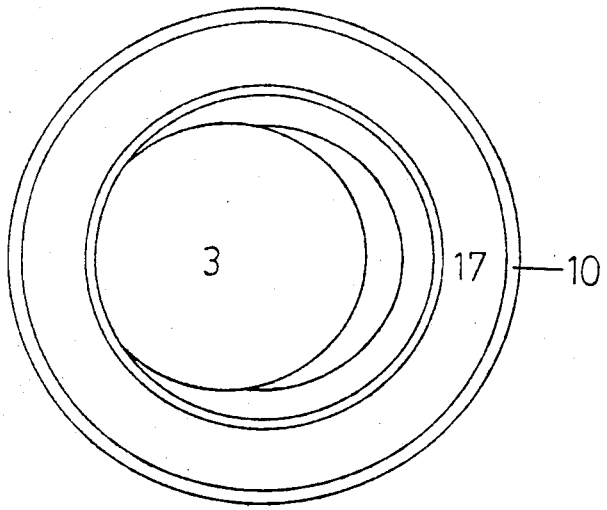
FIG. 3 is a top view of the embodiment of FIG. 1.
Figure 4:
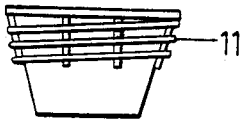
FIGS. 4 to 9 show alternative embodiments of the supporting surface for the lower lip.
Figure 5:
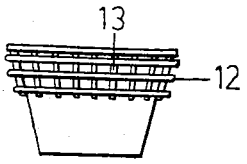
Figure 6:
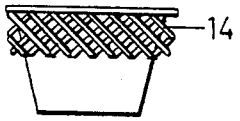
Figure 7:
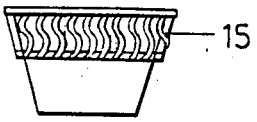
Figure 8:
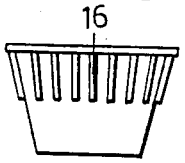

The example of embodiment of the device according to the invention, as illustrated in FIGS. 1, 2 and 3, is composed of a supply member 1 for the liquid, a supporting surface 2 for the lower lip, which at the same time constitutes the feeding arrangement for the gas, and is so designed that the lower lip can occlude at most a part of the gas feed and a supporting surface 3 for the upper lip in a such way that the upper lip can occlude at most a part of the liquid supply and in part blocks the free discharge opening 5 of the holder, the surface 3 cooperating with the upper lip to serve at the same time as a feed valve.

The gas, which may be constituted by the surrounding air, will thus at all times be capable of flowing through the openings 7 in the supporting surface 2 for the lower lip.

Figure 10:
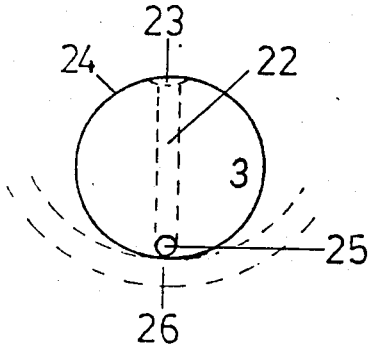
FIG. 10 is a top view of an embodiment where an arrangement for the supply of gas is included in the supporting surface.

It is to be noted that the left-hand part of the drinking rim 26 of the holder, as shown in FIG. 10, is put in contact with the mouth where-upon it is possible to drink in the usual manner from the holder.

For satisfactory operation, it has been found efficient for the feed valve or supporting surface 3 to have a round or elliptical form and to be provided eccentrically in the supply member 1 for the liquid, at a certain distance from the discharge opening 5 which is to be taken into the mouth. The magnitude of the dose is determined by the level and the size of the supporting surface 3 inside the holder. In FIG. 1, the example of embodiment is designed according to the invention in such a way that the supporting surface 3 is arranged at right angles to the longitudinal central axis of the supply member 1 for the liquid. The supporting surface 2 for the lower lip consists of a number of elements 9 which are interconnected by mounting members 8 and provided at least locally in an arrangement which is parallel in at least one direction, in such a way that the elements 9 are retained by the mounting members 8 at a certain distance from the wall of the supply member 1 for the liquid.

In the example of embodiment as shown in FIGS. 1, 2 and 3, the mounting members 8 consist of bar-shaped pieces that are distributed along the periphery of the holder for the liquid. The construction is furthermore so designed that the supporting surface 2 for the lower lip is constituted by a grating of rings 10, which rings 10 are parallel to the discharge opening 5 of the supply member 1 for the liquid. Other possible forms of embodiment may be so designed that:

(a) The supporting surface 2 for the lower lip consists of a coiled element 11, the longitudinal central axis of which coincides with the longitudinal central axis of the supply member 1 for the liquid.

(b) The supporting surface 2 for the lower lip consists of a grating of elements, which grating extends along at least part of the periphery of the supply member 1 for the liquid, in such a way that:

either the design of the grating is orthogonal and composed of elements 12 that are curved in one direction and of linear elements 13;

or the grating is composed of unidirectionally curved elements 14 arranged in an inclined position.

(c) The supporting surface 2 for the lower lip is composed of sinusoidal elements 15.

(d) The supporting surface 2 for the lower lip is composed of finite elements 16, which are arranged parallel to each other at an angle to the central axis along the periphery of the supply member 1 for the liquid, and which follow the curvature thereof.

To prevent the liquid from leaking, it can be desirable to provide a sealing ring 17 along the discharge opening 5 of the supply member 1 for the liquid between this supply member 1 and the supporting surface 2 for the lower lip.

A complete occulusion of the oral cavity buy the lip is prevented by the action of the construction 26 for the drinking rim. While drinking, therefore, gas and liquid will flow simultaneously into the mouth. The supporting surface 3 restricts the available amount of liquid in such a way as to produce an ideal gas-to-liquid ratio in the oral cavity.

During a roentgenographic examination of, for example, the esophagus, swallowing will be accompanied by a desired dilatation of the entire esophagus, and furthermore a thin film of the contrast liquid will form on the mucous membrane. In this manner, outstanding roentgenograms of the entire esophagus are produced in double contrast. In order to prevent air from leaking through the nose during drinking, the nose passage should be closed under the pressure of a small clamp or of the fingers.

The device constituted by the supporting surface 3 for the upper lip, the supporting surface 2 for the lower lip and the sealing ring 17 can be an integrated part of the holder, or can be fitted separately in whole or in part on the rim of the holder, the device then consisting of at least two parts which are mutually detachable. It is thus possible for the supporting surface 3 for the upper lip, the supporting surface 2 for the lower lip and the sealing ring 17 to form one whole, and to be fitted as one whole on the rim of the holder, as shown in FIGS. 1, 2 and 3, or for the supporting surface 3 for the upper lip to be designed detachably and replaceably, the supporting surface 2 for the lower lip and the sealing ring being integral with the holder.

Depending on preference for a disposable system or for a sterilizable type, a selection may be made from the aforementioned possibilities, as well as from possible constructional materials, such asplastics for the disposable type or metal alloys for the sterilizable type. It is also optional whether the supporting surface 2 for the lower lip is to be provided all around the holder, or whether the supporting surface 2 for the lower lip is dimensioned in accordance with the surface actually required for supporting the lower lip.

Figure 9:
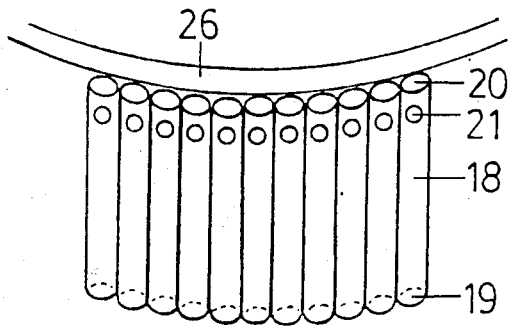

In such a case, a further embodiment is possible in which the supporting surface 2 for the lower lip consists of a number of hollow bodies 18 that are arranged side by side, the ends 19 of which, being situated outside the reach of the lower lip, are open, and the ends 20 of which, situated inside the lower lip, are closed, openings 21 being provided near these ends 20 in the side walls of the hollow bodies, which openings 21 are situated in the mouth during drinking, as shown in FIG. 9.

Figure 11:
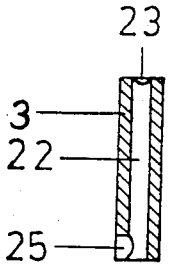
FIG. 11 is a sectional view of the supporting surface of FIG. 10.

Gas feeding arrangements are furthermore possible in the supporting surface 3, to which end the supporting surface 3 is equipped with at least one gas supply pipe 22, one end 23 of which opens near the free edge 24 of the feed valve 3 outside the reach of the upper lip, the other end 25 opening near the drinking rim 26 inside the upper lip, as shown diagrammatically in FIGS. 10 and 11.

Figure 12:
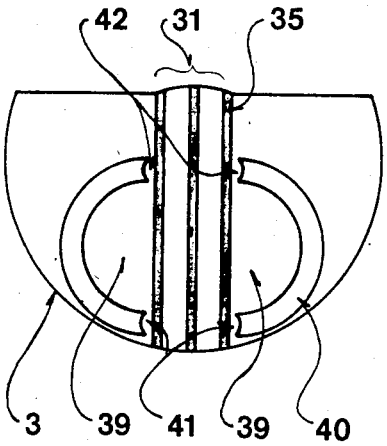
FIG. 12 is a partial top view of an embodiment of the supporting surface wherein the gas feeding arrangement is consisting of bar-shaped bodies and grooves.
Figure 13:
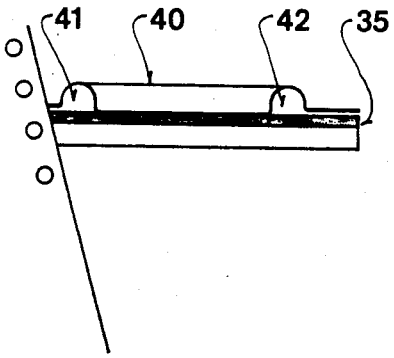
FIG. 13 and FIG. 14 are sectional views of the supporting surface of FIG. 12 at its location in the liquid holder.
Figure 14:
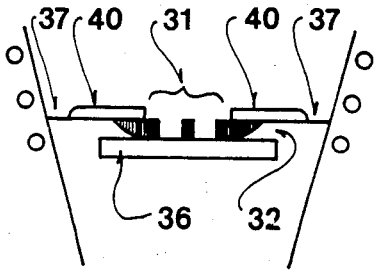

Another possible preferred embodiment of the supporting surface 3 is shown in FIGS. 12, 13 and 14.

By referring to the figures, the construction consists of:

a. a gas feeding arrangement consisting of bar-shaped bodies and grooves 31 mounted on the middle third part of the supporting surface 3;

b. a lateral flow compartment 32 for the liquid on either side of the surface from which the discharge area of the holder 1 will be supplied with liquid.

Bar-shaped bodies and grooves 31 are arranged parallel to each other running perpendicular to the tangent of the surface and the holder. This construction serves as a supporting surface for the upper lip and at the same time provides a continuous supply of gas. It is so designed that when placed against the upper lip, this area of the surface cannot be completely occluded by the upper lip. The gas (room air) will thus at all times be capable of flowing along the grooves into the mouth during drinking. This will ensure the attainment of an optimal gas to liquid ratio.

The construction of the flow compartment 32 aims at canalizing and retaining the liquid in its course from the internal part to the discharge area of the holder. The action of this flow compartment prevents liquid spill and variations in liquid intake.

This flow compartment is laterally located with respect to the surface and narrows towards the discharge area. The walls of the flow compartment are constituted by:

the wall of the holder (side-wall)

the outermost located bar-shaped bodies (medial-wall): 35 the surface edge (bottom-wall): 36 the laterally located plates (top-wall): 37

The plates are attached to the outer third part of the surface and close off the area above the surface and the area adjacent to it thus providing a ceiling for the flow compartment.

The shape of the plates can be compared with the quadrant of a circle of which the convexity is adjacent to the inner wall of the holder and following its circumference in close opposition so that liquid spill will be prevented.

The medial sides of these plates are provided with sloping dimples 39 which below are attached to the valve and above provide a supporting surface for the upper lip. The dimples allow the upper lip to be positioned in the same plane as the surface thereby making possible the aforementioned mechanism of the supply of gas.

Constructed around these dimples and merging into the bordering folds there are feeding channels 40 for the liquid and outlets 41 for the discharge area of the holder. The outlets placed above 42 the two feeding channel outlets (when in use) have no function. When the holder is tilted contrast medium will flow through the compartment 32 from the reservoir of the holder towards the outlets 41. Due to the funnel shape (FIGS. 12, 14) of this flow compartment the flow of the contrast medium will be diminished to such an extent that the quantity eventually discharged will form an ideal admixture with the quantity of gas supplied by the gas feeding arrangement.

The following parameters are essential in determining the desired amount of contrast medium:

1. the size and the shape of the flow compartment;
2. the height of the plates above the surface.
3. the height and the length of the bar-shaped bodies;
4. the size of the outlets;
5. the size and the height of the surface in the holder;
6. the viscosity of the contrast medium.

These parameters have all been empirically established.

I claim:

1. Device for producing a gas-and-liquid mixture, such as for intake by humans, comprising a supply member for the liquid and a feeding arrangement for the gas, characterized in that the supply member for the liquid consists of a holder that is furnished with an element adapted to cooperate with a user's upper lip to comprise a liquid feed valve, which in part blocks the free discharge opening of the holder and can serve at the same time as a supporting surface for the upper lip, in such a way that the upper lip can occlude at most a part of the liquid supply and the supporting surface for the lower lip at the same time constitutes the feeding arrangement for the gas, and is so designed that the lower lip can occlude at most a part of the gas feed.

2. Device according to claim 1, characterized in that the element comprising the feed valve has a round or elliptical form and is provided eccentrically in the supply member for the liquid, at a certain distance from the discharge opening which is to be taken into the mouth.

3. Device according to claim 1, characterized in that the element comprising the feed valve is arranged at right angles to the longitudinal central axis of the supply member for the liquid.

4. Device according to claim 1, characterized in that the supporting surface for the lower lip consists of a number of elements which are interconnected by mounting members and provided at least locally in an arrangement which is parallel in at least one direction, in such a way that the elements are retained by the mounting members at a certain distance from the wall of the supply member for the liquid.

5. Device according to claim 4, characterized in that the supporting surface for the lower lip is constituted by a grating of rings, which rings are parallel to the discharge opening of the supply member for the liquid.

6. Device according to claim 4, characterized in that the supporting surface for the lower lip consists of a coiled element, the longitudinal central axis of which coincides with the longitudinal central axis of the supply member for the liquid.

7. Device according to claim 4, characterized in that the supporting surface for the lower lip consists of a grating of elements, which grating extends along at least part of the periphery of the supply member for the liquid.

8. Device according to claim 7, characterized in that the design of the grating is orthogonal and composed of elements that are curved in one direction and of linear elements.

9. Device according to claim 7, characterized in that the grating is composed of unidirectionally curved elements arranged in an inclined position.

10. Device according to claim 4, characterized in that the supporting surface for the lower lip is composed of sinusoidal elements.

11. Device according to claim 4, characterized in that the supporting surface for the lower lip is composed of finite elements, which are arranged parallel to each other at an angle to the central axis along the periphery of the supply member for the liquid, and which follow the curvature thereof.

12. Device according to claim 4, characterized in that a sealing ring is provided along the discharge opening of the supply member for the liquid between this supply member and the supporting surface for the lower lip.

13. Device according to claim 1, characterized in that the device consists of at least two parts which are mutually detachable.

14. Device according to claim 13, characterized in that the supporting surface for the upper lip, the supporting surface for the lower lip and the sealing ring form one whole.

15. Device according to claim 13, characterized in that the supporting surface for the upper lip is designed detachably and replaceably.

16. Device according to claim 1, characterized in that the supporting surface for the lower lip consists of a number of hollow bodies that are arranged side by side, the ends of which that are situated outside the reach of the lower lip being open, and the ends of which that are situated inside the lower lip being closed, openings being provided near the latter ends in the side walls of the hollow bodies, which openings are situated in the mouth during drinking.

17. Device according to claim 2, characterized in that the element comprising the feed valve is equipped with at least one gas supply pipe, one end of which opens near the free edge of the feed valve outside the reach of the upper lip, the other end opening near the drinking rim inside the upper lip.

18. Device according to claim 2, characterized in that the element comprising the feed valve consist of a gas feeding arrangement consisting of bar-shaped bodies and grooves mounted on the middle third part of the feed valve.

19. Device according to claim 18, characterized in that the element comprising the said feed valve has two plates attached to its outer third part, the medial sides of these plates being provided with sloping dimples the upper part of which is a supporting surface for the upper lip, the said plates closing off the area above the valve and the area adjacent to it thus providing a ceiling for a flow compartment canalizing and retaining the liquid during its course from the internal part to the discharge area of the holder.

* * * * *